US010744670B2

(12) United States Patent
Johansson et al.

(10) Patent No.: US 10,744,670 B2
(45) Date of Patent: Aug. 18, 2020

(54) CHAINSAW GUIDE BAR ROLLER BEARING SEAL

(71) Applicant: HUSQVARNA AB, Huskvarna (SE)

(72) Inventors: Jörgen Johansson, Jönköping (SE); Christian Liliegård, Jönköping (SE)

(73) Assignee: HUSQVARNA AB, Huskvarna (SE)

( * ) Notice: Subject to any disclaimer, the term of this patent is extended or adjusted under 35 U.S.C. 154(b) by 0 days.

(21) Appl. No.: 15/555,177

(22) PCT Filed: Mar. 4, 2016

(86) PCT No.: PCT/IB2016/051234
§ 371 (c)(1),
(2) Date: Sep. 1, 2017

(87) PCT Pub. No.: WO2016/139634
PCT Pub. Date: Sep. 9, 2016

(65) Prior Publication Data

US 2018/0050463 A1 Feb. 22, 2018

Related U.S. Application Data

(60) Provisional application No. 62/128,242, filed on Mar. 4, 2015.

(51) Int. Cl.
*B27B 17/04* (2006.01)
*B27B 17/12* (2006.01)
(Continued)

(52) U.S. Cl.
CPC ..... *B27B 17/04* (2013.01); *B27B 17/0008* (2013.01); *B27B 17/025* (2013.01); *B27B 17/12* (2013.01)

(58) Field of Classification Search
CPC ..... B27B 17/04; B27B 17/008; B27B 17/025; B27B 17/12; B27B 17/00; B27B 17/02
(Continued)

(56) References Cited

U.S. PATENT DOCUMENTS 3,334,670 A 8/1967 Merz
3,636,995 A 1/1972 Newman
(Continued)

FOREIGN PATENT DOCUMENTS

CA 753084 A 2/1967

OTHER PUBLICATIONS

International Search Report and Written Opinion for International Application No. PCT/IB2016/051234 dated Jun. 6, 2016.

*Primary Examiner* — Phong H Nguyen
(74) *Attorney, Agent, or Firm* — Burr & Forman, LLP

(57) ABSTRACT

A chainsaw (100) includes a power unit and a working assembly powered responsive to operation of the power unit. The working assembly includes a guide bar (120) around which a chain is rotatable. The guide bar (120) includes first and second side plates (200 and 210), a sprocket wheel (220), first and second shims (240 and 242), and first and second sealing members (244 and 245). The first and second side plates (200 and 210) each face other and extend away from a housing (110) to a nose. The sprocket wheel (220) is provided at the nose between the first and second side plates (200 and 210). The first and second shims (240 and 242) are disposed between the first and second side plates (200 and 210), respectively, and corresponding ones of first and second sides of the sprocket wheel (220). The first sealing member (244) is disposed between the first shim (240) and the first side of the sprocket wheel (220). The second sealing member (245) is disposed between the second shim (242) and the second side of the sprocket wheel (220).

14 Claims, 7 Drawing Sheets

(51) Int. Cl.
*B27B 17/00* (2006.01)
*B27B 17/02* (2006.01)

(58) Field of Classification Search
USPC ..... 30/381, 383–387
See application file for complete search history.

(56) References Cited

U.S. PATENT DOCUMENTS 3,870,125 A 3/1975 Gorski
3,878,607 A * 4/1975 Ehlen ..... B27B 17/04 30/387
4,117,594 A 10/1978 Arbuckle
4,159,569 A * 7/1979 Sundstrom ..... B27B 17/04 30/384
4,321,750 A 3/1982 Sugihara
4,947,550 A * 8/1990 Wenzel ..... B27B 17/025 30/123.3
5,092,044 A * 3/1992 Edgerton ..... B27B 17/12 30/123.4
5,461,789 A 10/1995 Beerens

* cited by examiner

CHAINSAW GUIDE BAR ROLLER BEARING SEAL

CROSS REFERENCE TO RELATED APPLICATION

This application claims priority to U.S. provisional application No. 62/128,242 filed on Mar. 4, 2015, the entire contents of which are incorporated herein by reference.

TECHNICAL FIELD

Example embodiments generally relate to hand held power equipment and, more particularly, relate to a guide bar improvements for a chainsaw.

BACKGROUND

Chainsaws are commonly used in both commercial and private settings to cut timber or perform other rigorous cutting operations. Because chainsaws are typically employed in outdoor environments, and the work they are employed to perform often inherently generates debris, chainsaws are typically relatively robust hand held machines. They can be powered by gasoline engines or electric motors (e.g., via batteries or wired connections) to turn a chain around a guide bar at relatively high speeds. The chain includes cutting teeth that engage lumber or another medium in order to cut the medium as the teeth are passed over a surface of the medium at high speed.

Given that the chainsaw may be employed to cut media of various sizes, the length of the guide bar can be different for different applications. However, in most situations, the guide bar is relatively long, and may actually be substantially longer than the main body of the chainsaw. The guide bar is typically made of steel, and thus, the guide bar can be a substantial contributor to the overall weight of the chainsaw.

Reducing the weight of the chainsaw can allow it to be more easily controlled and carried for long periods of time. However, weight is not the only concern or point of possible improvement in relation to guide bar design. As such, it may be desirable to explore a number of different guide bar design improvements that could be employed alone or together to improve overall chainsaw performance.

BRIEF SUMMARY OF SOME EXAMPLES

Some example embodiments may provide for a guide bar constructed with laminate cores that can be glued together to incorporate various improvements. In some cases, the core laminate construction may allow a roller bearing assembly to be provided for a sprocket wheel in a nose wheel of the guide bar. In some cases, a seal may be provided around such a roller bearing assembly. Other improvements may also be possible, and the improvements can be made completely independent of each other, or in combination with each other in any desirable configuration. Accordingly, the operability and utility of the chainsaw may be enhanced or otherwise facilitated.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
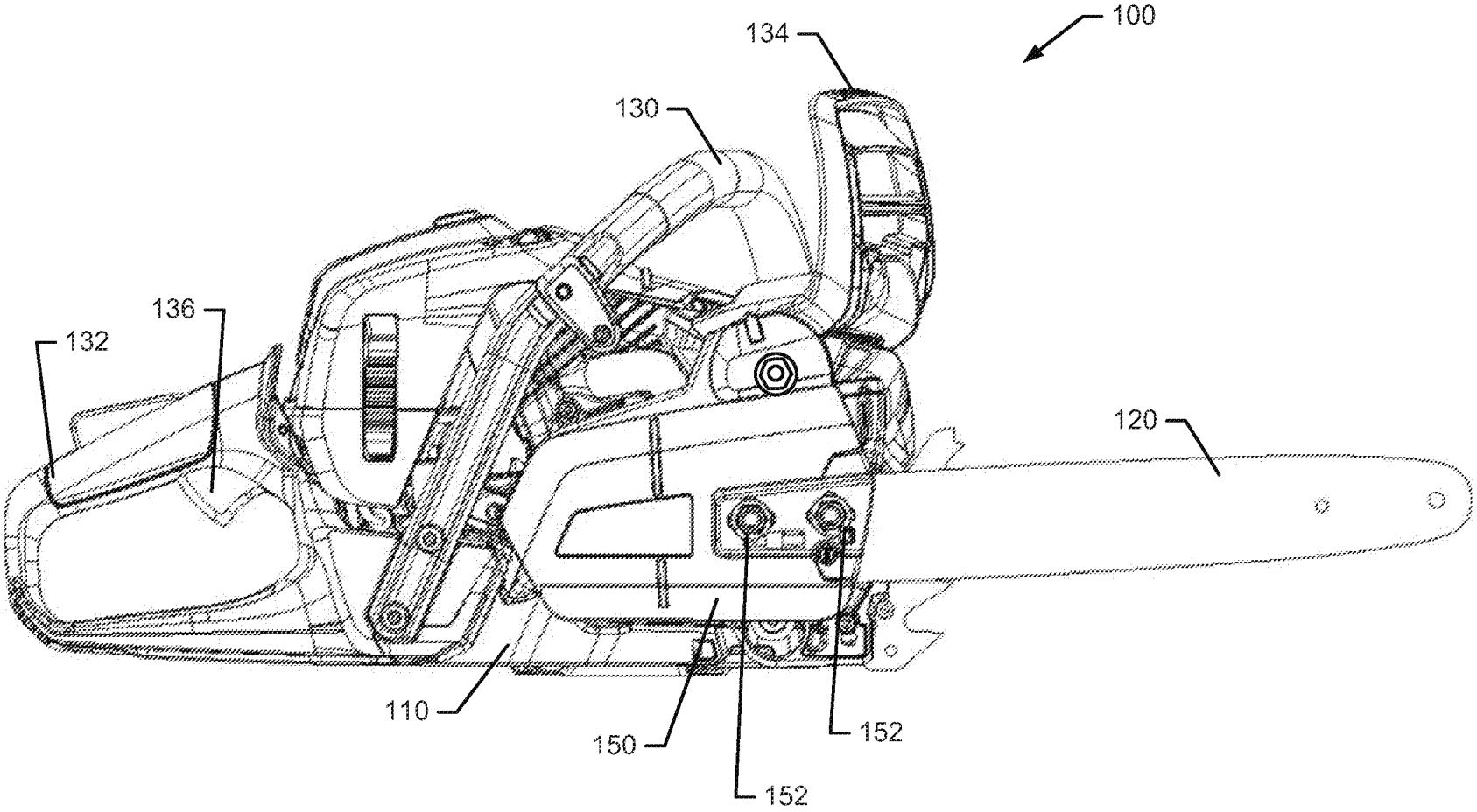
FIG. 1 illustrates a side view of a chainsaw according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

FIG. 1 illustrates side view of a chainsaw 100 according to an example embodiment. As shown in FIG. 1, the chainsaw 100 may include a housing 110 inside which a power unit or motor (not shown) is housed. In some embodiments, the power unit may be either an electric motor or an internal combustion engine. Furthermore, in some embodiments, the power unit may include more than one electric motor where one such electric motor powers the working assembly of the chainsaw 100 and the other electric motor of the power unit powers a pump that lubricates the working assembly or provides momentum for moving other working fluids within the chainsaw 100. The chainsaw 100 may further include a guide bar 120 that is attached to the housing 110 along one side thereof. A chain (not shown) may be driven around the guide bar 120 responsive to operation of the power unit in order to enable the chainsaw 100 to cut lumber or other materials. The guide bar 120 and the chain may form the working assembly of the chainsaw 100. As such, the power unit may be operably coupled to the working assembly to turn the chain around the guide bar 120.

The chainsaw 100 may include a front handle 130 and a rear handle 132. A chain brake and front hand guard 134 may be positioned forward of the front handle 130 to stop the movement of the chain 122 in the event of a kickback. In an example embodiment, the hand guard 134 may be tripped by rotating forward in response to contact with a portion of the arm (e.g., the hand/wrist) of the operator of the chainsaw 100. In some cases, the hand guard 134 may also be tripped in response to detection of inertial measurements indicative of a kickback.

The rear handle 132 may include a trigger 136 to facilitate operation of the power unit when the trigger 136 is actuated. In this regard, for example, when the trigger 136 is actuated (e.g., depressed), the rotating forces generated by the power unit may be coupled to the chain either directly (e.g., for electric motors) or indirectly (e.g., for gasoline engines). The term "trigger," as used herein, should be understood to represent any actuator that is capable of being operated by a hand or finger of the user. Thus, the trigger 136 may represent a button, switch, or other such component that can be actuated by a hand or portion thereof.

Some power units may employ a clutch to provide operable coupling of the power unit to a sprocket that turns the chain. In some cases (e.g., for a gasoline engine), if the trigger 136 is released, the engine may idle and application of power from the power unit to turn the chain may be stopped. In other cases (e.g., for electric motors), releasing the trigger 136 may secure operation of the power unit. The housing 110 may include a fuel tank for providing fuel to the power unit. The housing 110 may also include or at least partially define an oil reservoir, access to which may be provided to allow the operator to pour oil into the oil reservoir. The oil in the oil reservoir may be used to lubricate the chain as the chain is turned.

As can be appreciated from the description above, actuation of the trigger 136 may initiate movement of the chain around the guide bar 120. A clutch cover 150 may be provided to secure the guide bar 120 to the housing 110 and cover over the clutch and corresponding components that couple the power unit to the chain (e.g., the sprocket and clutch drum). As shown in FIG. 1, the clutch cover 150 may be attached to the body of the chainsaw 100 (e.g., the housing 110) via nuts 152 that may be attached to studs that pass through a portion of the guide bar 120. The guide bar 120 may also be secured with the tightening of the nuts 152, and a tightness of the chain can be adjusted based on movement of the guide bar 120 and subsequent tightening of the nuts 152 when the desired chain tightness is achieved. However, other mechanisms for attachment of the clutch cover 150 and/or the guide bar 120 may be provided in other embodiments including, for example, some tightening mechanisms that may combine to tighten the chain in connection with clamping the guide bar 120.

As mentioned above, the guide bar 120 can be an important contributor to the weight of the chainsaw 100. Thus, it may be desirable to provide various improvements to the guide bar 120 to improve the functionality and/or decrease the weight of the guide bar 120. Various example embodiments will now be described in reference to FIGS. 2-5, which illustrate some of these example embodiments.

Figure 2:
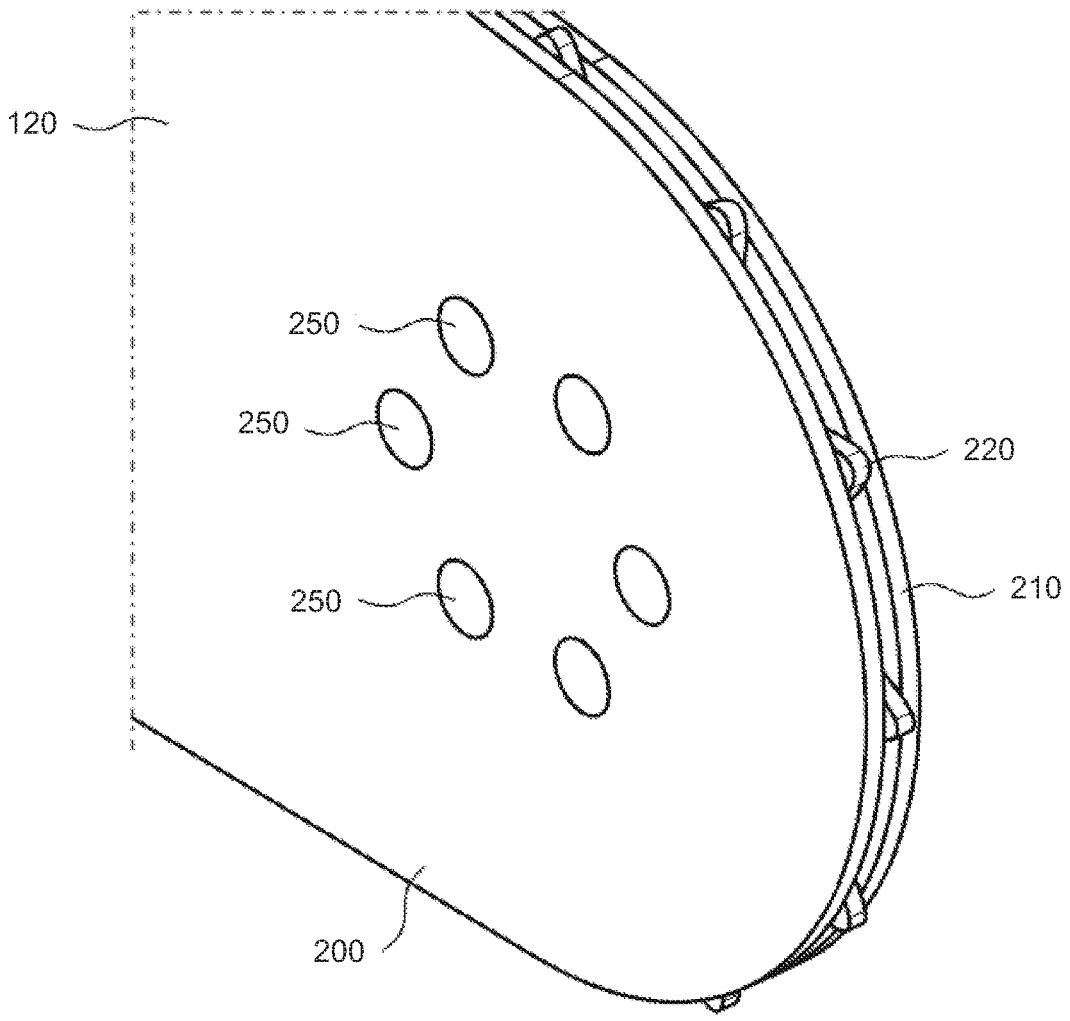
FIG. 2 illustrates a perspective view of an axial end (e.g., a forward portion or nose) of the guide bar of FIG. 1 in accordance with an example embodiment.
Figure 3:
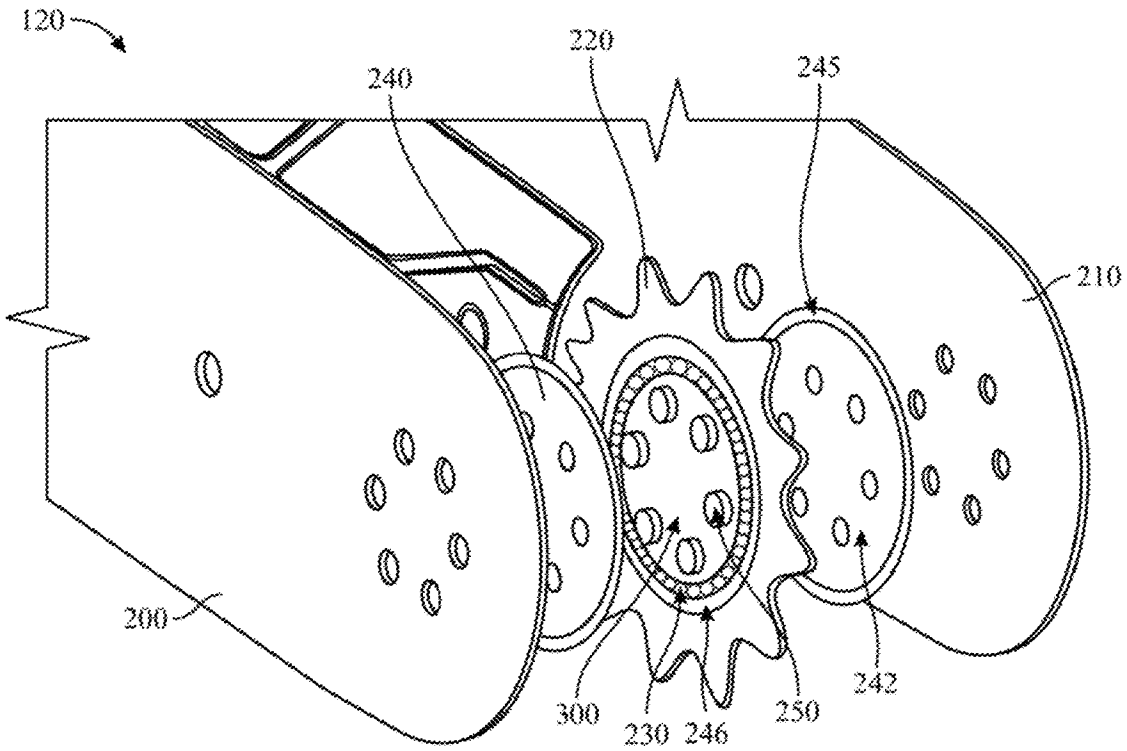
FIG. 3 illustrates an exploded perspective view of the axial end of the guide bar from the same perspective shown in FIG. 2 in accordance with an example embodiment.
Figure 4:
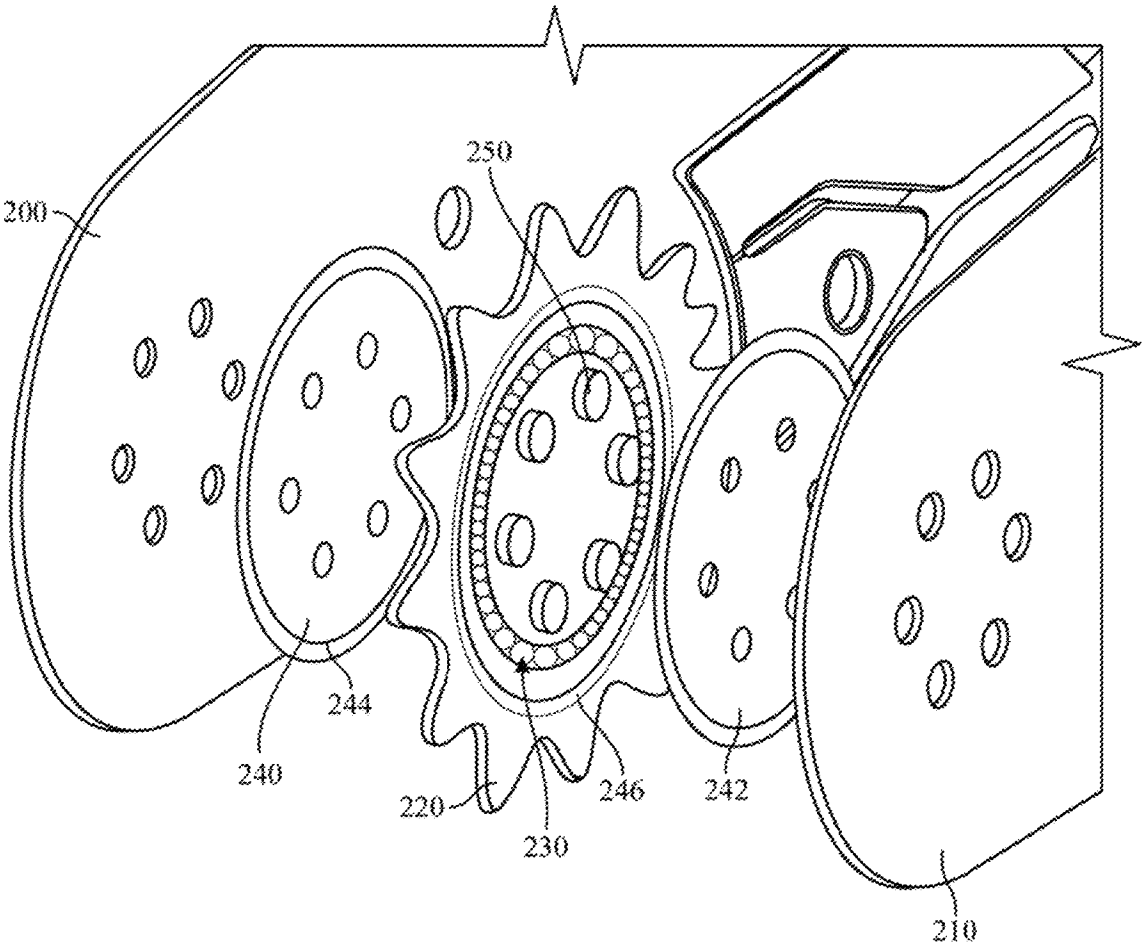
FIG. 4 illustrates an exploded perspective view of the axial end of the guide bar from the opposing perspective in accordance with an example embodiment.
Figure 5:
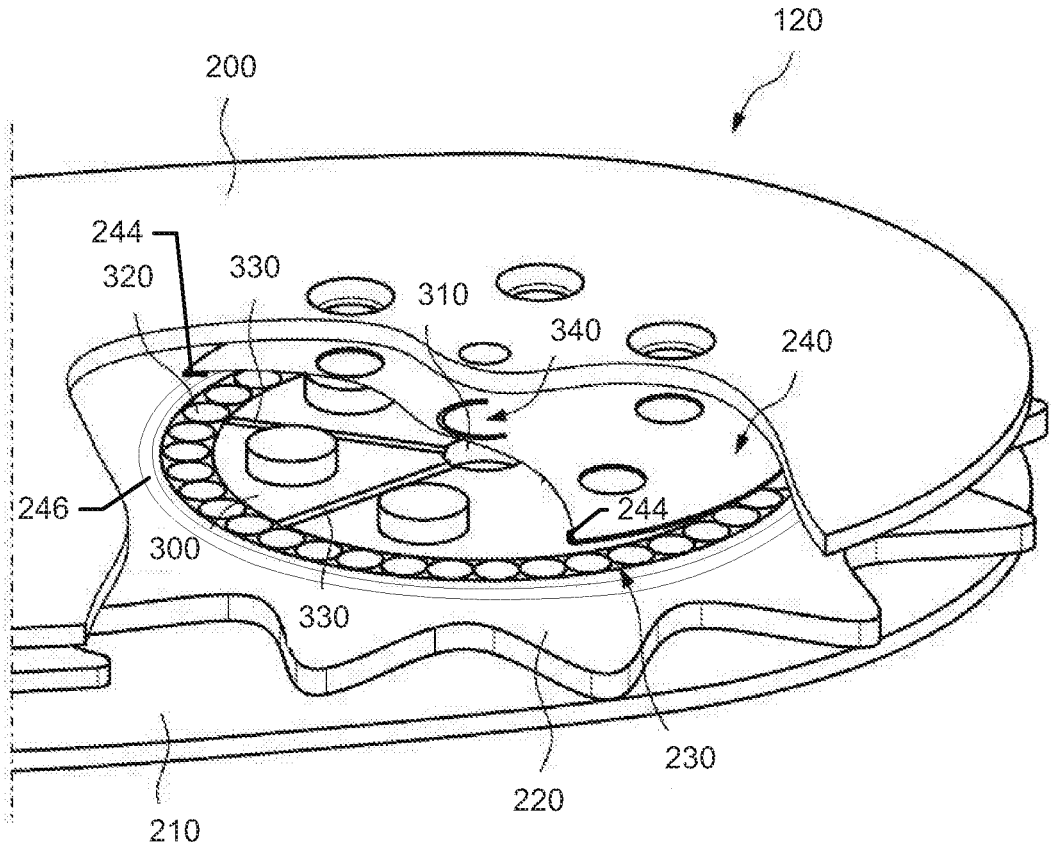
FIG. 5 illustrates a partially cutaway perspective side view of the axial end with portions of a side plate of the guide bar and shim removed to expose a roller bearing assembly in accordance with an example embodiment.

In this regard, FIG. 2 illustrates a perspective view of an axial end (e.g., a forward portion or nose) of the guide bar 120 in accordance with an example embodiment. FIG. 3 illustrates an exploded perspective view of the axial end from the same perspective shown in FIG. 2, and FIG. 4 illustrates an exploded perspective view from the opposing perspective in accordance with an example embodiment. FIG. 5 illustrates a partially cutaway perspective side view of the axial end with portions of a side plate of the guide bar 120 and shim removed to expose a roller bearing assembly in accordance with an example embodiment.

Referring to FIGS. 2-5, it can be appreciated that the guide bar 120 may be formed from two laminate core sheets that lie in parallel planes along side each other. These laminate core sheets may be made from stainless steel or other sufficiently rigid and durable materials. The laminate core sheets may be referred to herein as a first side plate 200 and a second side plate 210, respectively. The first and second side plates 200 and 210 may generally be spaced apart from each other be at least a certain distance, which may be substantially consistent over the lengths of the first and second side plates 200 and 210. In some embodiments, a sprocket wheel 220 may be provided in the space between the first and second side plates 200 and 210. The sprocket wheel 220 may be rotatable to interface with the cutting chain as the cutting chain turns around the axial end of the guide bar 120. The sprocket wheel 220 may be supported by a bearing assembly 230 described in greater detail below.

In an example embodiment, a shim may be provided between the sprocket wheel 220 and each of the first and second side plates 200 and 210. As such, a first shim 240 may be provided between the first side plate 200 and the sprocket wheel 220, and a second shim 242 may be provided between the second side plate 210 and the sprocket wheel 220. Each of the first and second shims 240 and 242 may be a relatively thin (e.g., about 0.1 mm) steel plate. The first and second shims 240 and 242 may perform a sealing function relative to lubrication of components provided in the bearing assembly 230.

As such, in an example embodiment, each of the first and second shims 240 and 242 may have a sealing member (e.g., first sealing member 244 and second sealing member 245, respectively) provided proximate to a periphery thereof. The first and second sealing members 244 and 245 may each be a rubber gasket or other such sealing component that may or may not be slightly compressible and which sits between a face of each of the first and second shims 240 and 242 and the respective opposing faces of the sprocket wheel 220. Thus, the first sealing member 244 engages an inner face of the first shim 240 at an inner facing portion of the periphery of the first shim 240. Moreover, the first sealing member 244 is pinched or clamped between the first shim 240 and the corresponding face of the sprocket wheel 220. Similarly, the second sealing member 245 engages an inner face of the second shim 242 at an inner facing portion of the periphery of the second shim 242, and the second sealing member 245 is pinched or clamped between the second shim 242 and the corresponding face of the sprocket wheel 220.

In some embodiments, the sprocket wheel 220 may also include a groove 246 on each side thereof provided concentric with the bearing assembly 230 and formed to match the size and shape of the first and second sealing members 244 and 245. The groove 246 may be formed by stamping or machining. Accordingly, the first and second shims 240 and 242 may provide an effective seal around the bearing assembly 230 by providing sealing along the axial direction, whereas the first and second sealing members 244 and 245 provide sealing in the radial direction. In some cases, the first and second sealing members 244 and 245 may be injection molded onto the inner faces of the first and second shims 240 and 242, respectively. Moreover, the first and second shims 240 and 242 may be produced by an etching process.

Rivets 250 may be provided to fix the bearing assembly 230, sprocket wheel 220, first and second shims 240 and 242, and the first and second side plates 200 and 210 together. As such, receiving holes may be formed and aligned in each of these components and the rivets 250 may pass through the aligned receiving holes to hold the entire assembly together. Although six rivets are shown in the examples, any number of rivets 250 could be employed in various example embodiments.

As shown in FIG. 5, the bearing assembly 230 may include a hub 300 having lubrication reservoir 310 disposed at a center thereof. The lubrication reservoir 310 may hold a lubricant (e.g., oil or grease) that can be provided to rolling elements 320 of the bearing assembly 230 via one or more channels 330 that may extend from the lubrication reservoir 310 toward the rolling elements 320 of the bearing assembly 230. The channels 330 may generally extend radially outwardly between the lubrication reservoir 310 and the rolling elements 320.

The rolling elements 320 may be stainless steel spheres that are arranged in an annular channel formed around the hub 300. In an example embodiment the sprocket wheel 220 may have a hollow center and the hub 300 may fit within the hollow center. The hub 300 is fixed by the rivets 250, but the sprocket wheel 220 is to move with the movement of the chain. Thus, the bearing assembly 230 provides an interface to permit the rotation of the sprocket wheel 220 about the hub 300. As such, the rolling elements 320 may be disposed in the space between the inner periphery of the sprocket wheel 220 and the outer periphery of the hub 300. The rolling elements 320 may form a roller bearing assembly that allows relative motion between the hub 300 and the sprocket wheel 220 while the chain is being rotated, and the rolling elements 320 may be lubricated by the lubricant from the lubrication reservoir 310 during this process.

In some embodiments, at least one of the shims (e.g., the first shim 240) may include a valve element 340 disposed proximate to the lubrication reservoir 310 to facilitate sealing of the lubricant between the shims and the sprocket wheel 220 (i.e., proximate to the hub 300 and the rolling elements 320 of the bearing assembly 230, but allow the lubricant to be inserted into the lubrication reservoir 310. Accordingly, while the sprocket wheel 220 rotates, the first and second shims 240 and 242 may be protected from damage, and the first and second shims 240 and 242 may also hold the rolling elements 320 in place.

Figure 6:
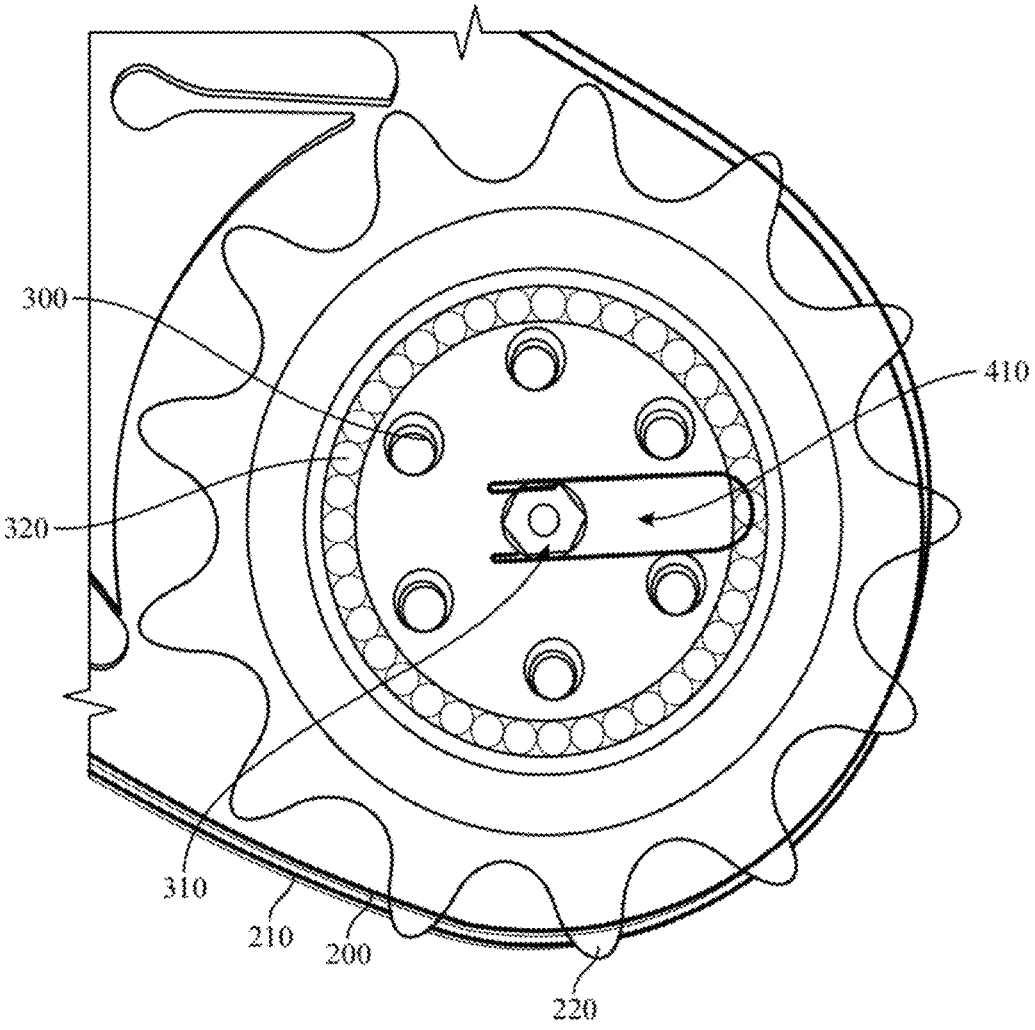
FIG. 6 illustrates a perspective side view of the axial end with side plates of the guide bar and shim partially transparent to expose a roller bearing assembly in accordance with an example embodiment.
Figure 7:
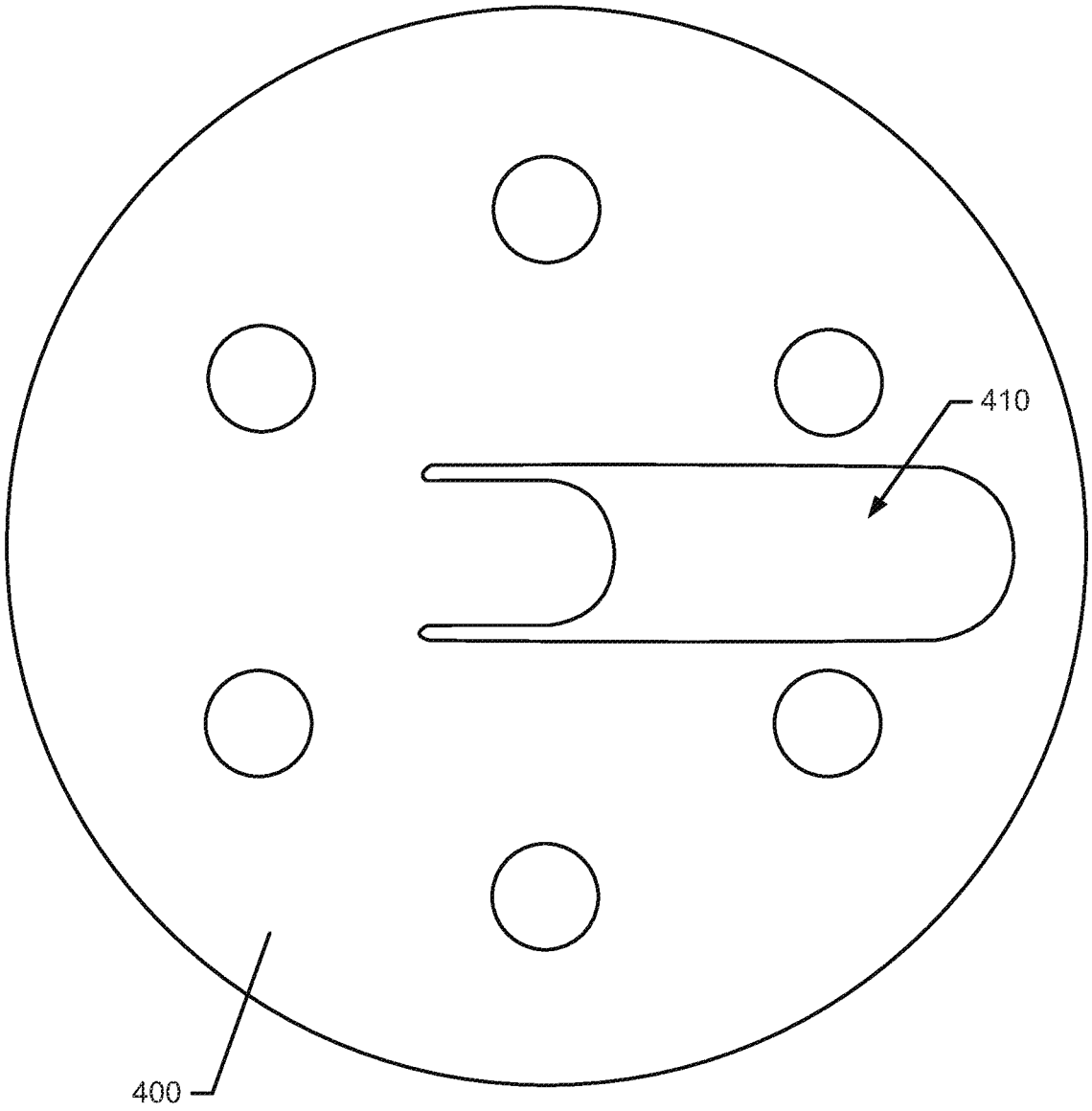
FIG. 7 illustrates a top view of a shim in accordance with an alternate example embodiment.

The example described above may enable lubrication to the bearing assembly 230 through the channels 330 formed in the hub 300. However, the channels 330 may be formed by machining of the hub 300. As an alternative to employing machining of the hub 300, an alternative example embodiment may instead provide a lubrication channel in a shim, which could be stamped or punched in the shim instead of requiring machining. FIGS. 6 and 7 illustrate such an example. In particular, FIG. 7 illustrates a top view of such a shim 400. The shim 400 includes a channel 410 that can be punched in the shim 400 instead of requiring machining of the hub 300. The lubrication reservoir 310 may still be formed in the hub 300. However, the shim 400 may be positioned between the hub 300 and one (or both) of the first and second side plates 200 and 210 (or sealing members associated therewith). Lubricant can pass from the lubrication reservoir 310 through the channel 410 to lubricate the rolling elements 320. Thus, as can be seen in FIG. 6, the channel 410 overlaps with the lubrication reservoir 310 and the rolling elements 320, and provides a passage for lubricant therebetween. It should also be noted that although FIGS. 6 and 7 show the channel 410 as a single passage, some embodiments may employ multiple such passages (e.g., multiple channels).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

The invention claimed is:

1. A chainsaw comprising:

a power unit disposed in a housing; and a working assembly powered responsive to operation of the power unit, the working assembly comprising a guide bar around which a chain is rotatable, wherein the guide bar comprises:

a first side plate and a second side plate facing each other and extending away from the housing to a nose of the guide bar;

a sprocket wheel provided at the nose of the guide bar between the first side plate and the second side plate;

a first shim disposed between the first side plate and a first side of the sprocket wheel;

a second shim disposed between the second side plate and a second side of the sprocket wheel;

a first sealing member disposed between the first shim and the first side of the sprocket wheel;

a second sealing member disposed between the second shim and the second side of the sprocket wheel;

a bearing assembly comprising rolling elements and a hub, the hub having a lubrication reservoir formed therein; and a channel configured to provide a passage for lubricant, the channel extending between the lubrication reservoir and the rolling elements, wherein the channel is formed in one of the first shim or the second shim.

2. The chainsaw of claim 1, wherein the first and second sealing members comprise gaskets made of rubber.

3. The chainsaw of claim 1, wherein the first and second sealing members are each positioned proximate to a periphery of the first and second shims, respectively.

4. The chainsaw of claim 1, wherein the first and second sides of the sprocket wheel each include respective grooves provided therein, the grooves substantially matching a size and shape of the first and second sealing members to facilitate receiving the first and second sealing members, respectively.

5. The chainsaw of claim 1, wherein the first and second sealing members are injection molded onto the first and second shims, respectively.

6. The chainsaw of claim 1, wherein the channel is punched in one of the first shim or the second shim.

7. The chainsaw of claim 1, wherein the first shim is disposed between a first side of the first side plate and the first side of the sprocket wheel; wherein the second shim is disposed between a first side of the second side plate and the second side of the sprocket wheel; wherein the first sealing member is disposed between a first side of the first shim and the first side of the sprocket wheel; and wherein the second sealing member is disposed between a first side of the second shim and the second side of the sprocket wheel.

8. A guide bar for guiding a chain of a chainsaw, the guide bar comprising:

a first side plate and a second side plate facing each other and extending toward a nose of the guide bar;

a sprocket wheel provided at the nose of the guide bar between the first side plate and the second side plate;

a first shim disposed between the first side plate and a first side of the sprocket wheel;

a second shim disposed between the second side plate and a second side of the sprocket wheel;

a first sealing member disposed between the first shim and the first side of the sprocket wheel;

a second sealing member disposed between the second shim and the second side of the sprocket wheel;

a bearing assembly comprising rolling elements and a hub, the hub having a lubrication reservoir formed therein; and a channel configured to provide a passage for lubricant, the channel extending between the lubrication reservoir and the rolling elements, wherein the channel is formed in one of the first shim or the second shim.

9. The guide bar of claim 8, wherein the first and second sealing members comprise gaskets made of rubber.

10. The guide bar of claim 8, wherein the first and second sealing members are each positioned proximate to a periphery of the first and second shims, respectively.

11. The guide bar of claim 8, wherein the first and second sides of the sprocket wheel each include respective grooves provided therein, the grooves substantially matching a size and shape of the first and second sealing members to facilitate receiving the first and second sealing members, respectively.

12. The guide bar of claim 8, wherein the first and second sealing members are injection molded onto the first and second shims, respectively.

13. The chainsaw of claim 1, wherein the channel extends radially outwardly from the lubrication reservoir to the rolling elements.

14. The guide bar of claim 13, wherein the channel is punched in one of the first shim or the second shim.

* * * * *